United States Patent [19]

Topel

[11] Patent Number: 4,961,264

[45] Date of Patent: Oct. 9, 1990

[54] RESTRAINT ALIGNMENT ASSEMBLY FOR USE WITH A STRING-MOUNTED PEEPSIGHT

[76] Inventor: Kenneth D. Topel, 11220 164th St. E., Puyallup, Wash. 98374

[21] Appl. No.: 313,381

[22] Filed: Feb. 21, 1989

[51] Int. Cl.[5] ..... F41G 1/467; F41G 11/00

[52] U.S. Cl. ..... 33/265; 124/90

[58] Field of Search ..... 33/265; 124/87, 90, 124/23 R, 24 R

[56] References Cited

U.S. PATENT DOCUMENTS

| | | | |
|---|---|---|---|
| 1,885,962 | 11/1932 | Swenson et al. | 124/23 R |
| 3,618,586 | 11/1971 | Current et al. | 33/265 |
| 3,859,733 | 1/1975 | Chesnick | 33/265 |
| 4,011,853 | 3/1977 | Fletcher | 33/265 |
| 4,116,194 | 9/1978 | Topel | 33/265 |
| 4,552,121 | 11/1985 | Treaster | 33/265 |
| 4,563,821 | 1/1986 | Saunders | 33/265 |
| 4,625,422 | 12/1986 | Carlson | 33/265 |
| 4,656,747 | 4/1987 | Troncoso | 33/265 |
| 4,833,786 | 5/1989 | Shores, Sr. | 33/265 |

OTHER PUBLICATIONS

Fine Line, Inc., Fine Line Zero Sight, Bow and Arrow, May 1985.

*Primary Examiner*—Thomas B. Will

*Attorney, Agent, or Firm*—Christensen, O'Connor, Johnson & Kindness

[57] ABSTRACT

An improved restraint and alignment assembly for use with a string-mounted archery peepsight includes a nonelastic member, such as a flat-braid nylon cord that is tied between an eyelet on a post extending from the peepsight and an eyelet formed in a connector, which, in turn, is fastened to one end of an elastic member, such as a portion of latex surgical tubing. A second end of the elastic member is fastened to a post extending from an anchor pad secured to the inside of an upper limb of a compound bow. The nonelastic member extends through a safety clip that surrounds a cable of the compound bow at a location between the connector and the peepsight. The foregoing arrangement serves to limit any unwanted rearward travel of portions of the elastic member if the elastic member fails to be continuously secured between the anchor pad and the connector, thereby preventing any portion of the elastic member from reaching the face or eyes of the archer.

8 Claims, 3 Drawing Sheets

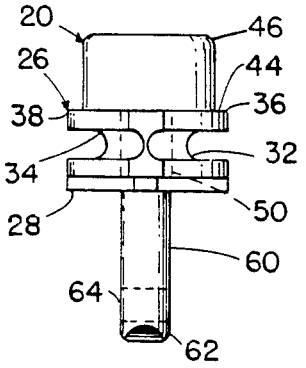
FIG.6
FIG.9
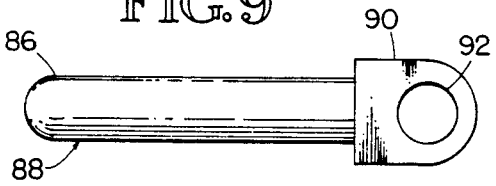
FIG.10
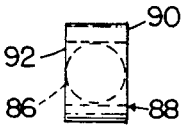
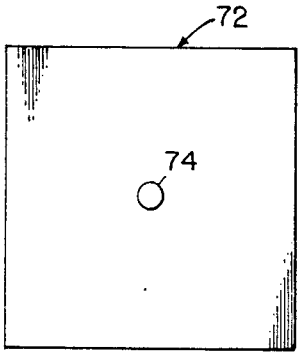
FIG.7
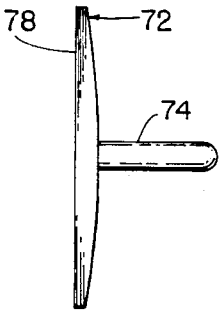
FIG.8
FIG.11
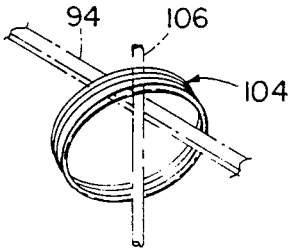

RESTRAINT ALIGNMENT ASSEMBLY FOR USE WITH A STRING-MOUNTED PEEPSIGHT

BACKGROUND

In U.S. Pat. No. 4,116,194 of 1978, Kenneth D. Topel illustrates and describes his improved peep sight for an archery bow. This peep sight includes an elastic cord secured at the forward end to a pin or post of an anchor pad adhesively secured to the inside of the upper limb of a bow, and secured at the rear end to a pin or post extending out from the forward face or surface of the body of the peep sight. This arrangement comprises a restraint alignment subassembly, which is utilized to offset any tendency of a bow string to twist, and to thereby keep the sighting bore of the peep sight in line with the intended direction of the flight of an arrow, i.e. in line with the bow sight and the target.

In U.S. Pat. No. 4,136,462 of 1979 Kenneth D. Topel illustrates and describes his adjustable crosshairs sight for an archery bow. His peep sight, as set forth in U.S. Pat. No. 4,116,194, and his peep sight as set forth in this application, serve an archer very well, so he or she may achieve greater accuracy and precision in aiming an arrow using any target sighting equipment, but especially when using such multiple crosshairs or multiple crosspins sights secured to an archery bow.

SUMMARY

An improved peep sight to further increase an archer's ability to accurately and to precisely aim an arrow toward a target is provided for use with all types of sights attached to a bow. The body of the peep sight has a modified angular projecting front surface centered around the sighting bore in the body of the peep sight, which positions the exit of this sighting bore in a plane, which is perpendicular to the aiming line of sight through the bow sight and on to the target. Also there is an overhanging light shield portion of this angular projecting front surface, which reduces the chance of light reflecting in on a side of the sighting bore, which might otherwise distort the archer's view of the bow sight and the target.

Also this improved peep sight has a modified angular overhanging projecting rear visor surface, on the body thereof. This projecting rear visor surface serves as a light shield over the eye of the archer to avoid any distracting lighting, and to thereby improve an archer's view of the bow sight and the target.

Moreover, this improved peep sight has an improved restraint alignment subassembly. The components of this subassembly are:

a post on the peep sight, which has an eyelet;

a non elastic member, such as a flat braid nylon cord, which is tied between the eyelet of the post of the peep sight, and an eyelet of an elongated connector;

an elongated connector, which has the eyelet to receive the non elastic member, and which is in turn fastened to an elastic member, such as a portion of a latex surgical tubing;

a portion of a latex surgical tubing which is fastened to the elongated connector, and which is in turn fastened to a post of an anchor pad secured to the inside of the upper limb of a bow;

an anchor pad, which has the post to receive an end of the latex surgical tubing, and which is secured to the inside of the upper limb of the bow; and a safety ring which is positioned about a cable of a bow at a locale between the elongated connector and the peep sight, and the non elastic member is threaded through the safety ring.

This arrangement is the improved restraint alignment subassembly, which serves to limit any unwanted extensive rearward travel of portions of the elastic member, while still providing the excellent sighting positioning control of the peep sight. If the elastic member should ever fail to be continuously secured between the post of the anchor pad and the elongated connector, no portion of the elastic member will reach the face and eyes of an archer.

DRAWINGS

The improved peep sight for an archery bow, having also an improved restraint alignment subassembly is illustrated in the drawings wherein.

Figure 3:
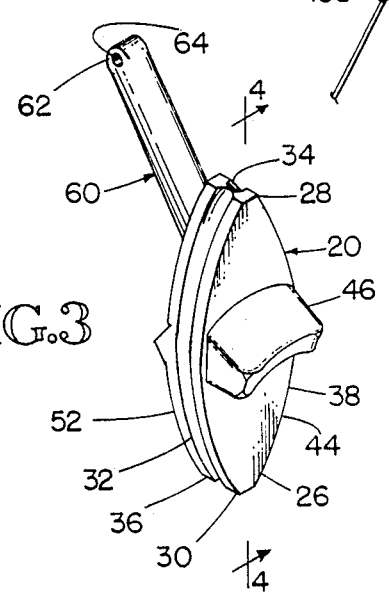
FIG. 3 is a perspective view of the improved peep sight, as viewed from the rear thereof.
Figure 4:
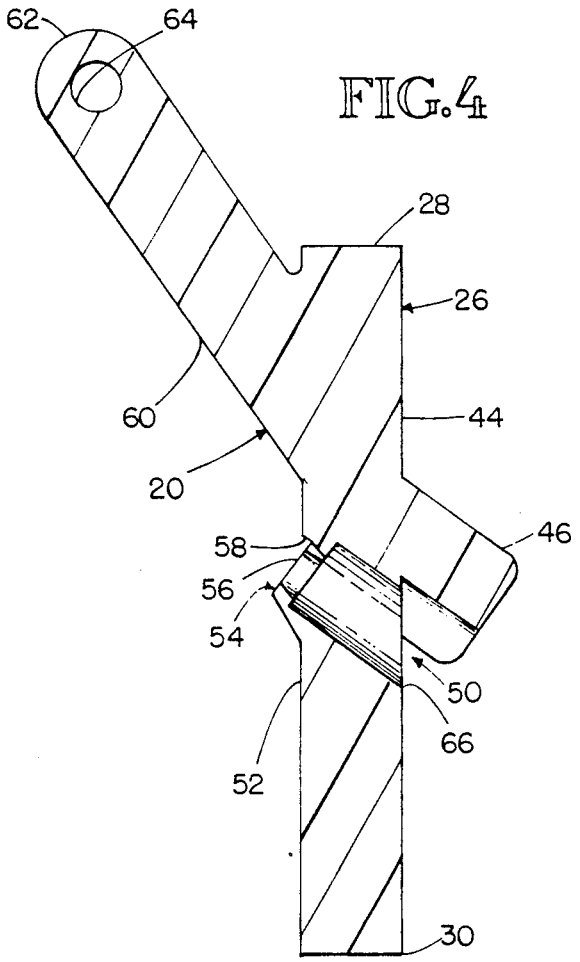
Figure 5:
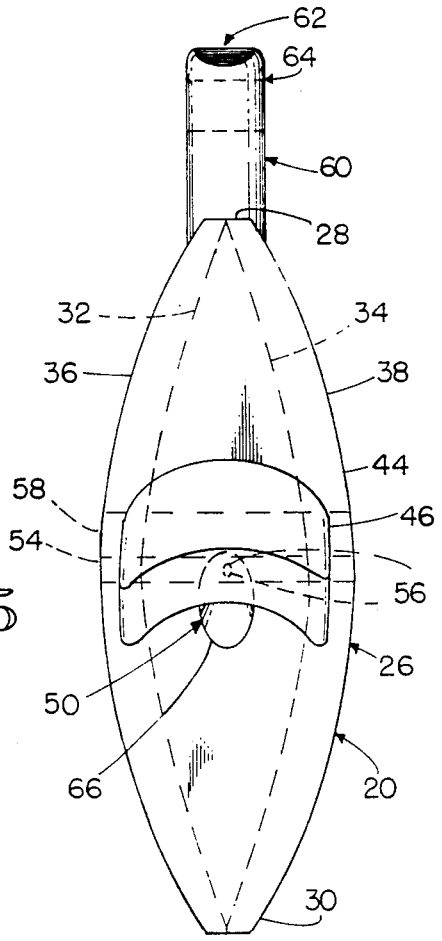

FIG. 4 is a vertical section view taken through the center of the improved peep sight, as indicated by section line 4—4 in FIG. 3, to illustrate: the modified angular projecting front surface centered around the sighting bore of the body of the peep sight which includes an overhanging light shield portion, and the modified angular overhanging projecting rear visor surface located over the sighting bore;

FIG. 5 is a rear elevation view of the improved peep sight;

FIG. 6 is a top view of the improved peep sight;

FIG. 7 is a front view of the anchor pad;

FIG. 8 is a side view of the anchor pad;

FIG. 9 is a side view of the connector;

FIG. 10 is an eyelet end view of the connector; and

FIG. 11 is a perspective view of the safety ring.

DESCRIPTION OF THE PREFERRED EMBODIMENTS

The Improved Peep Sight for an Archery Bow

Figure 1:
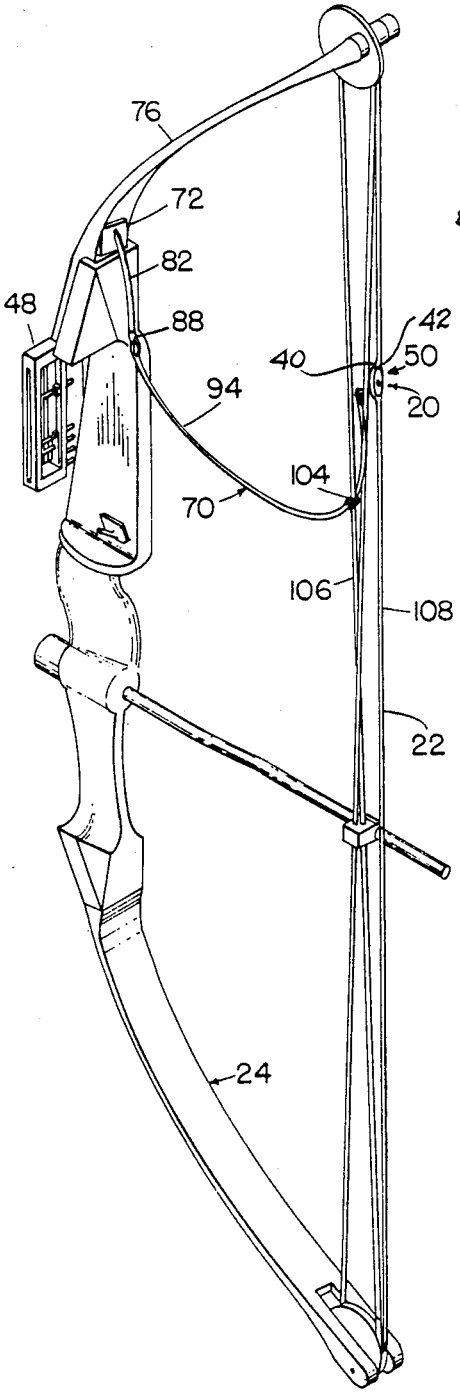
FIG. 1 is a perspective view of a compound bow equipped with a bow sight having several spaced crosshairs or crosspins, and also equipped with the improved peep sight and the improved restraint alignment subassembly.
Figure 2:
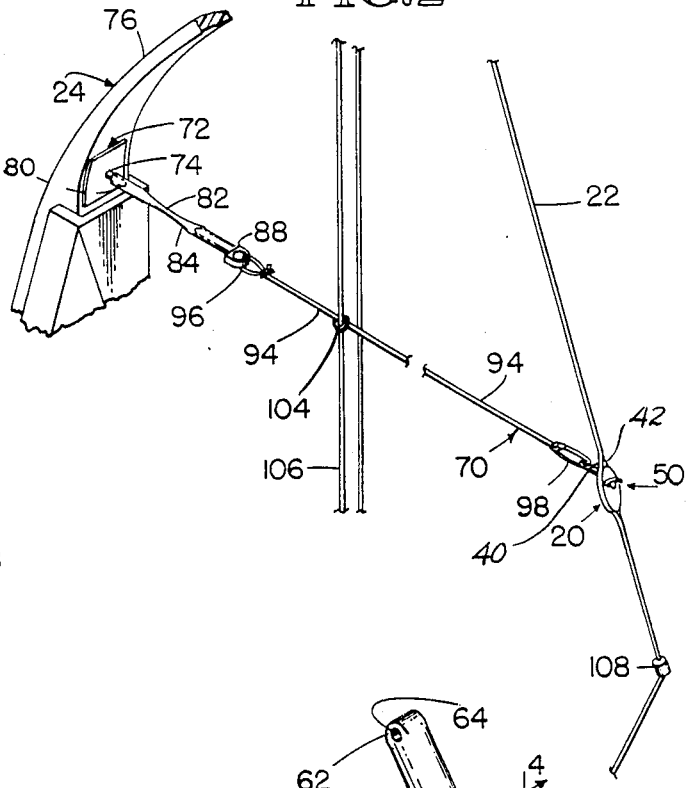
FIG. 2 is an enlarged perspective view of portions of a compound bow equipped with the improved peep sight and the improved restraint alignment subassembly.

The improved peep sight 20 is secured to the bow string 22 in reference to the full draw configuration of a bow 24, such as a compound bow 24, at the archer's normal eye position, as shown in FIGS. 1 and 2. The body 26 of the peep sight 20 is elongated, as shown in FIGS. 3, 4, and 5, ending in a pointed top end 28, and a pointed bottom end 30. Grooves 32, 34 are respectively formed on the left side 36 and right side 38 of this body 26. The braided bow string 22 is parted so two respective portions, left 40, and right 42 are positioned in the left 32 and right 34 grooves of the body 26. To maintain this position of the peep sight 20 on the bow string 22, a small diameter nylon cord is wrapped around the bow string 22 adjacent the top end 28 and bottom end 30 of the body 26 of the peep sight 20.

On the rear or eye face 44 of the body 26 of the peep sight 20, in the central area thereof, there is a modified angular overhanging projecting rear visor surface 46 of an arcuate visor configuration serving as a light shield, to avoid any distortion of the archer's view of the bow sight 48 and the target, not shown, as he or she looks through the sighting bore 50 of the body 26 of the peep sight 20.

On the front face 52 of the body 26 of the peep sight 20, in the central area thereof, there is a modified angular projecting front surface 54, which is centered around the sighting bore 50. This angular projecting surface makes the exit portion 56 which is of a reduced diameter, perpendicularly positioned to the line of sight, through the sighting bore 50, and on through the bow sight 48, and on through to the target.

Also this angular projecting front surface 46 includes an overhanging light shield portion 58, which reduces the chance of light reflecting in on a side of the sighting bore 50, which might otherwise distort the archer's view of the bow sight 48 and the target.

Above this angular projecting front surface 46 on the front face 52 of the body 26 of the peep sight 20, a post 60 extends upwardly and forwardly, at an angle, beyond the pointed top end 28 of the body 26 and includes at its projecting end 62 an eyelet 64. The angle of projection of this post 60, in reference to the vertical centerline of the body 26, is greater than the angle of the sighting bore 50, in reference to the vertical centerline of the body 26.

The sighting bore 50, commences with a larger diameter portion 66 and terminates with a reduced diameter exit portion 56, which is about one quarter the length of the larger diameter portion 66.

The angle of the sighting bore is fifty five degrees, plus or minus one degree in reference to the vertical, or longitudinal, centerline of the body 26 of the peep sight 20. If the peep sight 20, once mounted, is correctly aligned so the sighting bore 50 is directed in the intended direction of the flight of the arrow and directed toward the bow sight and beyond to a target, and no twisting tendency of the bow string 22 could be expected, then peep sight 20 would not need a restraint alignment subassembly 70. However, the twisting tendency of a bow string 22 is generally present and such twisting tendency must be restrained to keep the wanted alignment of the sighting bore 50 with the bow sight 48 and the target.

The Improved Restraint Alignment Subassembly

The improved restraint alignment subassembly 70 shown in FIGS. 1 and 2, extends between an anchor pad 72, having a perpendicular centered post 74, which is secured to the upper limb 76 of the bow, well above the bow sight 48, and the post 60 on the body 26 of the peep sight 20. The anchor pad 72 is secured by using a double side adhesive tape 78, initially secured to the anchor pad 72 and covered with a release paper, not shown.

Snugly and frictionally fitted over the post 74 of the anchor pad 72 is the hollow leading end 80 of a portion of latex surgical tubing 82, serving as the elastic member 82. The hollow trailing end 84 of the latex surgical tubing portion 82 is snugly and frictionally fitted over the post like end 86 of a connector 88. The other end 90 of the connector 88 is enlarged to provide an eyelet 92.

A flat braided nylon cord 94, serving as the non elastic member 94, has a leading end 96 threaded through the eyelet 92 and then tied securely to itself, completing its securement to the connector 88. The trailing end 98 of this nylon cord 94 is threaded through a safety ring 104, after this safety ring 104 has been passed around a cable 106 of the bow 24. This safety ring 104 serves as a restraining component member 104. This nylon cord 94 is of a length to be continued on to sufficiently reach the eyelet 64 on the peep sight 20, whereby its trailing end 98 is passed through the eyelet 64 and is then tied securely to itself.

When the bow string 22 is drawn to reach the maximum release position of the nock locator 108, the connector 88 is moved nearer the cable 106 but still remains clear of it. If the latex surgical tubing 82, in part or in whole, would become free by pulling loose or breaking, the connector 88 would stop at the safety ring 104 secured on the cable 106. This stopping place insures the surgical tubing 82 will not go beyond to reach the face or eyes of the archer.

Regarding Selection of Materials and Their Manufacture

Preferably, the improved peep sight 20, the anchor pad 72, and the connector 88, will be injection molded using plastic materials such as A.B.S. plastic.

The latex surgical tubing 82 serves as the tough resilient elastic material portion 82 of the restraint and alignment subassembly 70.

The flat braided nylon cord 94 serves as the strong non elastic member 94 of the restraint and alignment subassembly 70.

General Comments Regarding These Improvements of the Peep Sight and the Restraint Alignment Subassembly An archer who equips his or her bow 24 with the improved peep sight 20, is able to sight through the sighting bore 50 without experiencing reflected light distortions. Moreover, the archer who equips his or her bow 24 with the improved restraint and alignment subassembly 70, is insured of continued good sighting through the sighting bore 50. If by a rare chance, the latex surgical tubing 82 becomes freed, for example, at one end or tears apart, and portions thereof move quickly in the direction of an archer's face and eyes, the latex surgical tubing 82 will be restrained with the connector 88 at the location of the safety ring 104 on the cable 106. Thereby the latex surgical tubing 82 will remain well clear of the nock locator 108 on the tightly drawn bow string 22.

I claim:

1. In a compound bow having a handle portion and upper and lower limbs extending in opposite directions from the handle portion, said upper and lower limbs linked by a cable, and said bow further including a bowstring extending between said upper and lower limbs and having a peepsight mounted in said bowstring, an improved alignment assembly for preventing twist of said peepsight, including:

an elastic member;

first means for attaching a first end of said elastic member to said upper limb;

a nonelastic member;

second means for attaching a first end of said nonelastic member to said peepsight;

third means for joining a second end of said elastic member to a second end of said nonelastic member; and a clip slidingly engaging said cable and slidingly receiving said nonelastic member.

2. The improved alignment assembly of claim 1, wherein said first means includes a first mounting pin fastened to said upper limb and said second means includes a second mounted pin attached to said peepsight.

3. The improved alignment assembly of claim 1, wherein said clip comprises a ring that surrounds both said cable and said nonelastic member.

4. The improved alignment assembly of claim 2, wherein said second mounting pin in integrally formed with said peepsight.

5. The improved alignment assembly of claim 2, wherein said first mounting pin is integrally formed with a mounting pad that is adhesively mounted on said upper limb.

6. The improved alignment assembly of claim 1, wherein said third means includes a rigid coupler, said second end of said elastic member being fastened to a first end of said coupler and said second end of said nonelastic member being fastened to a second end of said coupler.

7. The improved alignment assembly of claim 6, wherein said elastic member is a length of surgical tubing and is fitted over said first end of said coupler.

8. The improved alignment assembly of claim 6, wherein said second end of said coupler has an eye formed therein, said second end of said nonelastic member passing through said eye and being looped to fasten said nonelastic member to said coupler.

* * * * *